US005311830A

United States Patent [19]

Kiss

[11] Patent Number: 5,311,830

[45] Date of Patent: May 17, 1994

[54] METHOD OF ENERGETIC AND MATERIAL UTILIZATION OF WASTE GOODS OF ALL KIND AND DEVICE FOR IMPLEMENTING SAID METHOD

[75] Inventor: Günter H. Kiss, Monaco, Monaco

[73] Assignee: Thermoselect Aktiengesellschaft, Lichtenstein, Liechtenstein

[21] Appl. No.: 658,142

[22] Filed: Feb. 20, 1991

[30] Foreign Application Priority Data

| | | | |
|---|---|---|---|
| Feb. 23, 1990 | [DE] | Fed. Rep. of Germany | 4005804 |
| Apr. 12, 1990 | [DE] | Fed. Rep. of Germany | 4011945 |
| Jul. 16, 1990 | [DE] | Fed. Rep. of Germany | 4022535 |
| Oct. 19, 1990 | [DE] | Fed. Rep. of Germany | 4033314 |
| Dec. 17, 1990 | [DE] | Fed. Rep. of Germany | 4040377 |

[51] Int. Cl.[5] ..... F23G 5/12

[52] U.S. Cl. ..... 110/346; 110/223; 110/229; 110/256; 48/209

[58] Field of Search ..... 110/229, 256, 346, 223; 48/209

[56] References Cited

U.S. PATENT DOCUMENTS

| | | | |
|---|---|---|---|
| 3,812,620 | 5/1974 | Titus et al. . | |
| 4,306,506 | 12/1981 | Rotter | 110/229 |
| 4,650,546 | 3/1987 | Le Jeune | 110/223 X |
| 4,718,362 | 1/1988 | Santen et al. | 110/346 |
| 4,831,944 | 5/1989 | Durand et al. | 110/346 |
| 4,850,290 | 7/1989 | Benoit et al. | 110/346 |
| 4,976,208 | 12/1990 | O'Connor | 110/256 X |

FOREIGN PATENT DOCUMENTS

| | | |
|---|---|---|
| 116725 | 3/1930 | Fed. Rep. of Germany . |
| 363577 | 4/1974 | Fed. Rep. of Germany . |
| 3207203A1 | 9/1983 | Fed. Rep. of Germany . |
| 81/03629 | 12/1981 | France . |
| 1452037 | 1/1975 | United Kingdom . |

*Primary Examiner*—Edward G. Favors

*Attorney, Agent, or Firm*—Locke, Reynolds

[57] ABSTRACT

Methods and suitable devices for the intermediate storage, transport and preparation as well as utilization of waste goods of all kinds are described, said waste goods being compacted down to a plurality of its original volume while maintaining their mixed and composite structure, are stored in intermediate storage and are transported in this form, if required, and are so compacted subjected to a pyrolysis. The totality of the pyrolysis products being under elevated pressure is subsequently subjected immediately to a high-temperature treatment. The compacted waste goods may be crammed into containers and are subjected to a low-temperature pressure pyrolysis. In case of ecological preparation of consumption goods such as motor vehicle wrecks or the like, a large-volume apportioning of the scrap goods is carried out by subdividing and/or crushing prior to the intermittent feeding into the pyrolysis chamber. The solid, liquid and/or gaseous process products containing polluants are led through one or a plurality of molten baths or are melted down in a respective high-temperature furnace. The pyrolysis chamber may consist of a heatable tube or a rectangular channel or of a continuous-heating furnace which accepts a plurality of suitable containers with compacted waste goods.

19 Claims, 5 Drawing Sheets

Figure 1:
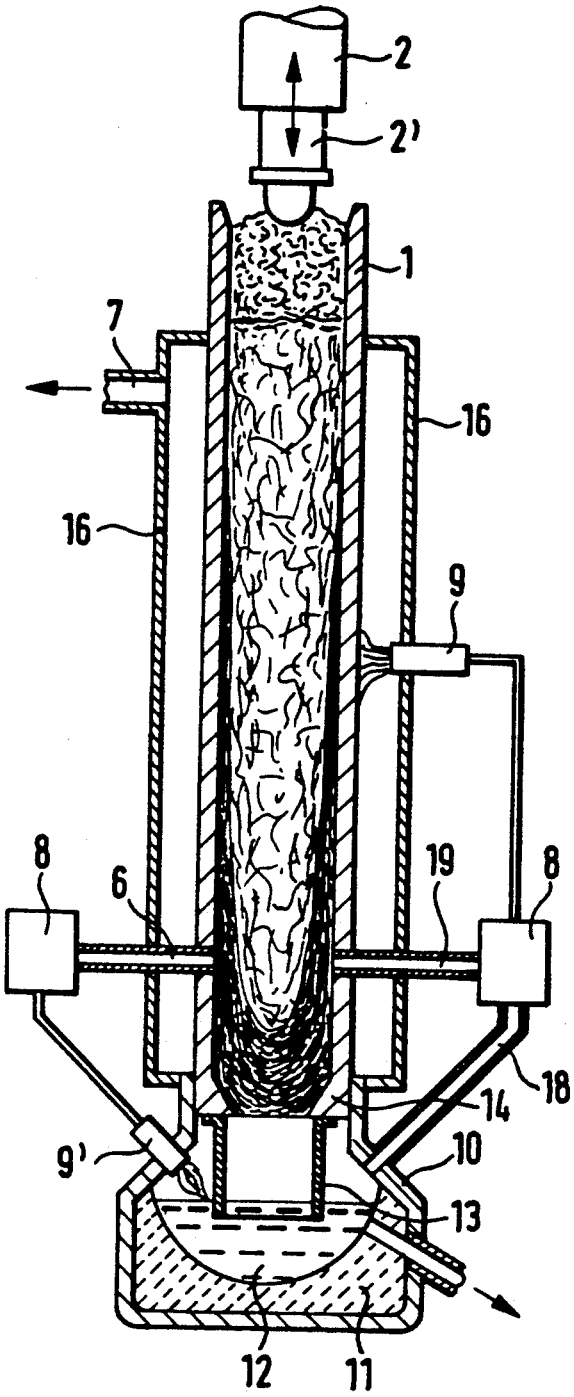

METHOD OF ENERGETIC AND MATERIAL UTILIZATION OF WASTE GOODS OF ALL KIND AND DEVICE FOR IMPLEMENTING SAID METHOD

This invention relates to a method of transporting, intermediate storage and utilization of waste goods of all kind and to devices for implementing said method.

Waste disposal methods practiced or approved up to now are inadequate and little convincing as regards resulting environmental problems. This is true both for the intermediate storage and for the transport to and from the waste disposal plants, and in particular for the preparation of the waste goods. The concept of "waste goods" comprises usual domestic and industrial wastes, industrial wrecks, but also dangerous wastes and waste goods stored on waste dumps.

The classical form of disposal of domestic and industrial wastes of all kind is still today the dumping on usually large waste dumps having to put up with partly very long transport routes.

A known alternative solution to dumping are refuse incinerating plants. The incineration of wastes engenders, however, many other disadvantages. The incineration is carried out up to now at a very low efficiency and produces a high rate of harmful substances. Considerable investment and operating costs will be required for the respective incineration plants.

The likewise known degasification of organic waste tried to avoid the refuse incineration for at least part of the waste goods produced, in order to be able to economically operate small plants.

Various pyrolysis methods are known which differ as regards the furnaces to be used therefor. Such used furnaces are:

1. Shaft furnaces into which the pyrolysis goods are loosely fed from above and run through the furnace shaft in vertical direction,
2. Rotary cylindrical kilns, in which the rotation of the rotary shaft mixes the bulkable pyrolysis goods up and brings it constantly into contact with the hot tube walls, and
3. Fluidized bed furnaces in which a sand bed or the like which is constantly in fluidized motion is meant to effect a close transfer of heat into the pyrolysis goods.

Degasification reactors such as known e.g. from AT-PS 1 15 725 and AT-PS 3 63 577 present a multitude of not yet satisfactorily solved problems. So the wastes to be pyrolyzed must be preliminarily crushed for improving the heat transfer, a fact which causes high costs, noise nuisance and dust production. In addition it is required to feed atmospheric air in great throughput quantities, maybe even with additional oxygen, with the organic matter for pyrolyzation, which accounts for a only small degree of efficiency. The heat-up of the wastes occurs relatively slowly. Pyrolysis furnaces with an economical throughput have a large volume and are operated at the limit of mechanical loadability being run at the required high temperatures of above 450° C. They are suitable for being operated approximately at atmospheric pressure. In order to prevent the emission of gaseous polluants, it is required that the degasification reactors are absolutely gas-tight which makes expensive temperature-loaded sluice constructions and sealings mandatory.

Very problematical was hitherto also the further processing of the pyrolysis coke produced in the form of dust, since its gasification is not possible at all on account of its lacking flow properties or only after a highly expensive briquetting process of the coal dust, due to complicated process engineering A thermic utilization of the gases of low-temperature pyrolysis loaded with condensate requires a previous dust separation at correspondingly high temperatures, since both the rotary kiln and the fluidized bed pyrolysis are highly dust producing. The load on the pyrolysis gases with thermally stable organic compounds, such as dioxins, requires a high-temperature combustion with defined periods of dwell of the gases in the reactor. The utilization of the highly polluant-loaded condensates as raw material for the petrochemistry is possible in exceptional cases only. In other cases, in particular the pyrolysis condensate constitutes a considerable environment problem. The solid residues of the known pyrolysis methods are polluant-loaded dump material as per definition of the environmental laws. If the carbon contents of such residues possesses adequate polluant-binding properties is unclear, at least with respect to its long-term resistance against elution, so that pyrolysis coke out of waste pyrolysis must be considered dangerous waste with the respective dump risks and costs.

In case of the ecological preparation of industrial wrecks in which the mixed scrap consists of iron parts and parts of non-ferrous metals and non-metallic organic and inorganic components of most different chemical and physical compositions, the car industry in particular and in this connection also the plastic industry and the scrap industry are called upon, to find new ways with regard to a recycling-relevant design of motor vehicles and the development of recycling methods and technologies for material which today is not yet utilizable. Considerably increased dump expenses and strengthened conditions for the waste disposal of industrial waste goods in a disposable form, indicate stringently to keep the non-recycling part in the preparation of consumption wrecks as low as possible.

The operation of giant scrap presses in the here interesting field of application has been substituted, for a considerable time, by the so-called shredder technique. Discarded consumption and industrial goods having a high metal portion are subjected to a purely mechanical material separation. The wrecks to be processed are, in parts or as a whole, dumped into the shredder plant in which a mixture of small parts of the multitude of the components of the starting material is produced, which subsequently is separated, preferably by physical methods.

In a known method (EP 0 012 019), crushed refuse is subjected to a heat treatment in a closed chamber in which a partial combustion of some constituent parts is carried out while adding an oxygen-containing flue gas, whereas other constituent parts are subjected to a pyrolysis reaction. On a second combustion step then pure oxygen is added and due to the consequent increase of the temperature up to 1300° to 1600° C. the combustion is terminated.

In this connection shall be mentioned a device for the selective separation of non-ferromagnetic metals from a mixture of crushed metallic scrap, such as it is produced in shredder plants (DE-AS 28 55 239), in which, by way of different heat baths, different discharge appliances are provided, corresponding to the various differing melting points of the non-ferrous metals such as lead, zinc and aluminum.

After the removal of at first the various non-ferrous metal parts there follows that of ferromagnetic parts by means of magnetically sorting out. This publication addresses particularly the great difficulties encountered in salvaging old metal consisting of mixtures with e.g. copper, zinc and lead portions, with a view to obtain a sufficient degree of purity for an economic re-utilization.

A method for the pyrolytic decomposition of industrial and domestic waste or the like refuse, in which the waste matters are decomposed in a reaction vessel by direct contact with a molten liquid heat carrier, has been known from DE-AS 23 04 369. The appropriately preheated waste matters are dipped continuously into the molten liquid heat carrier and the thus produced decomposition products are conveyed to the surface by circulating the molten mass and are withdrawn from there. Heat carrier is a molten inorganic substance and may consequently consist in this respect of one or several metals, alternatively also a glassy melt is possible which is kept liquid by adding heat.

This procedure is to allow to decompose large quantities of heterogeneous, collected waste matters without an expensive preliminary classification, in a continuous operation flow by pyrolysis under exclusion of air, and to transform them into non-harmful or useful products.

Directly establishing a contact of such only pre-dried waste mixtures with a molten liquid heat carrier into which the feed pipe for the waste substances would dip, is not possible in practice, because the residual humidity of the waste would cause an explosion-like gas formation at the exit end of the feed pipe. Moreover the pipe end dipping into the molten mass would relatively quickly be consumed.

Carrying out the pyrolysis within the liquid molten bath has the effect that the pyrolysis products ultimately would collect on the surface of the melt and that they must be withdrawn there in their totality. This mode of operation cannot exclude that still highly toxic polluant portions are emitted from the liquid bath. The inclusion of electrostatic filters downstream and elution plants and cool traps for withdrawing still present polluants, remains therefore mandatory even in the procedure according to DE-AS 23 04 369.

Finally another procedure for the largely water-free transformation of waste matters into glass form is to be mentioned here (DE-OS 38 41 889), in which ash produced by the combustion of waste matter together with aggregates is introduced into a glass melt, the produced waste gases are cooled, and their condensates are recycled into the glass melt. The waste gases free of dioxins and/or furans can be discharged after purification of the gases without being dangerous for the environment, which is true also for the solid matters mineralized in the glass bath, i.e. the combustion ashes.

The essential problem, in the case of every waste gas purification plant, is the final disposal of the residual substances. Same are present as reaction products in the form of dry crystallizates, dissolved salts and/or dusts which are in a high degree loaded with harmful matter. The disposal of such residues which are present in considerable quantities is problematic and requires constantly increasing space for dangerous-waste dumps.

Storage and transport of not prepared waste goods such as industrial and domestic waste is done with a relatively low bulk density, their physical and chemical instability, as well as the odor and gas generation in case of biologically decomposable waste, have an especially detrimental effect. An aggravating factor is the fact that many waste goods hold liquids containing harmful matters which they lose, at least partly, on transport or storage. Elutions due to atmospheric precipitations can scarcely be avoided during improper storage. The low bulk density of the waste goods causes a large transport volume. If an intermediate storage of the waste goods is envisaged—perhaps because the waste goods are to be prepared with a view to recycling and/or thermal utilization—government laws prescribe elution-safe dump installations of a considerable building volume or specially equipped sub-soil storage facilities. Considerable additional investment cost result therefrom. Also the transport of such waste goods causes considerable expenses already on account of its low bulk density.

In the case of chemically instable waste goods, besides a strong odor generation also toxic or dangerous gases may be emitted, so that there is the danger of explosion, in particular for storage bunkers without additional gas exhausts. Permanent exhausts, several times exchanging the air volume per hour and additional filter and safety installations are cost factors also during the intermediate storage of the waste goods.

For the transport of some waste goods, such as domestic waste, it is known to transport same in a slightly pre-compressed state by means of presses which are integrated into the vehicle. A subsequent thermal utilization of the waste goods is rendered technically difficult by its low bulk weight and the big volumes resulting therefrom Based on the totality of this prior art, it is the object of the present invention not only to create improved intermediate storage and transport conditions for industrial and domestic waste, industrial wrecks or waste goods of all kinds, but in particular to find a new way of shaping its energetic and material re-utilization and to guarantee a total ecologic waste disposal with an improved effectiveness of the procedure by means of simplified plants.

This object is achieved, according to the invention, by the characteristic features as stated in the definition of the species of claim 1.

Advantageous further developments and embodiments of this object are readily to be seen from the subclaims.

By preliminary compacting the waste goods—at first while maintaining its mixed and composite structure, i.e. without the application of expensive sorting processes and plants or the known prior art—to make packets of approximately the same geometry, said waste goods may be crammed without difficulty by means of a tamping device or the like into, e.g., an approximately tubular container, which will render both its subsequent transport and an intermediate storage, if any, as well as the pyrolysis process uncomplicated and non susceptible to failures. This pre-compacting into a suitable geometric shape which is adapted to a suitable container, according to the invention, prevents bulky component parts of the waste goods hindering the subsequent after-compacting process In its compacted state, the waste goods will have from only ⅓ up to 1/20 approximately of its original bulk, resulting in a likewise reduced storage and transport volume, independently of any subsequent thermal degasification or pyrolysis process of the waste goods.

It is true that any bulkable material may be packaged in the first compacting step of the waste goods by means of an open package such as a net envelope or a strap package, its introduction into a container with open front end has, however, the advantage that it is there additionally tightly enclosed, so that e.g. the odor emissions are restricted to a minimum and wash-outs, as e.g. in intermediate storage in wet rooms, are not to be feared. In this respect, also the open front faces of such containers may be closed water-tight without noticeable expenditure. Quite a series of advantages will result for any thermal and material preparation of the compacted and enclosed packaged waste goods subsequent to the transport and/or intermediate storage. So e.g. tightly packaged containers may be degassed in a chamber or continuous heating furnace without problem. The period of dwell in such pyrolysis chambers can be optimized according to criteria of process economy. There are no restrictive conditions as to length/diameter in case of suitable containers which pass through the pyrolysis furnace. Since also containers of larger diameter are utilizable, even larger and bulky industrial wrecks may thus be disposed of. If the case may be, the latter ones will first have to be apportioned in large volumes.

There are advantageous conditions for the thermal utilization of pyrolyzed waste goods in that all degasification products may directly be subjected to a high-temperature treatment without intermediate cooling. The densified coke produced, together with the mineral or metallic components, can easily be removed and subjected to the high-temperature treatment. On gasification of the residual carbon, water gas (CO, $H_2$) is produced due to the splitting of a part of the accompanying water vapor. The degasification products are split into low-molecular component parts. The reaction temperature is maintained due to the exothermic reaction of the coke present in densified form with oxygen. The thus released carbon dioxide reacts with carbon according to the Boudouard equilibrium to produce carbon monoxide. An optimum reaction and utilization of all products is assured in the high-temperature reactor.

The high temperatures connected with the gasification of carbon and the production of water gas lead to a directly utilizable energy-rich process gas without producing condensable organic components with strongly reduced water portion. Owing to the densified coke produced during the pyrolysis under pressure and the low flow speeds due to the process, produced dust portions in the process gas are reduced to a minimum.

The meltable metallic and mineral components of the reaction products form a metal or slags melt with partly very different densities in a melt-down gasifier during the high-temperature treatment, so that material components may be easily separated and adduced to an efficient utilization.

The carbon gasification and water gas production coupled with the melt-out of utilizable valuable substances may be advantageously carried out also in a shaft furnace of known construction by adding oxygen into the shaft containing the densified process coke in a manner as such known. Thereby temperatures of over 1500° C. may be produced in the solid pyrolysis residues without problem, at which both steels and other metals as well as glasses will melt out. Such valuable substances may be withdrawn in a fractionate tapping or in overflow. The application of oxygen instead of atmospheric air is of a considerable advantage for obtaining high temperatures, low gas flow speeds and volumes and for avoiding the formation of nitrogen-oxygen compounds.

The escape of the volatile compounds formed by thermal splitting from the tightly filled containers is furthered if perforated metallic tubes with open front faces or the like are used. Optimum conditions may be obtained as regards gas escape, production costs and degasification temperatures to be applied, if such tubes are adequately dimensioned.

The waste goods may also be introduced pre-compacted into thermally decomposable containers consisting of mechanically solid material for transport and intermediate storage, and later introduced and post-compacted into the thermally stable degasification tubes which are subjected to pyrolysis.

In a present embodiment, a plurality of containers such as tubular propelling-charge cartridges with additional radial rings enlarging their outer surface are propelled in circulation through a continuous-heating furnace. Thus it is possible to maximize the capacity of a plant.

The compacting of domestic waste or the like may decisively be improved if a sterilizing hot gas, preferably hot steam, impinges the waste goods during the pre-compacting step. This increases the possibility of its plastication and the chemical stability of the waste goods as well as the storageability without odor emission and gas formation.

On account of the desired high heat conductivity to and within the waste goods for pyrolysis, but also for reasons of storage, transport and optimum disposability volume for the degasification, it is feasible to fill the containers so that the bulk density of domestic waste on filling amounts to approximately 1 kg/dm$^3$. A periodically working hammer, driven mechanically, hydraulically or pneumatically, may be used as cramming device for the compact-filling of the containers.

If the compact-filled containers are to be intermediately stored for a longer time before they are brought to a thermal utilization, it is advantageous to close the front faces of the tubular containers filled with post-compacted waste goods using thermally decomposable foils or coats. By this, direct emissions of harmful substances into the environment are excluded on the one hand, and also odor emissions are prevented on the other. The thermally decomposable foil can be thermally utilized in the subsequent pyrolysis. Besides plastic foils also bituminous coatings are possible which can efficiently and simply be applied. As to the rest, such containers are practically self-cleaning on application of the pressure pyrolysis according to the invention. Their use optimizes not only the conditions for the pyrolysis itself, but reduces the transport volume by approximately 80% when such containers are used as transport containers. The densified pyrolysis coke produced as a result of the pyrolysis has excellent flow properties so that it is specially suitable for a subsequent coal gasification.

The above described process converts for the first time a part of the natural humidity of the waste into inflammable gas by means of the described carbon/water gas reaction during the waste pyrolysis.

In a specially preferred embodiment of the pyrolysis process according to the invention, the pyrolysis goods are compactedly entered into a pyrolysis chamber which consists of a single pyrolysis tube or of a channel-like pyrolysis furnace and are pushed through the heated tube or the channel while maintaining their compacted condition over the chamber cross section, the heat addition to the pyrolysis goods being carried out through the wall being in pressure contact with same, and resulting gaseous pyrolysis products are withdrawn at increased pressure.

The force-feed of the compacted pyrolysis goods guarantees a constant pressure contact between the pyrolysis goods and the heated chamber wall so that the heat transfer from the chamber walls to the pyrolysis goods is optimized.

In addition, the loss of volume in the pyrolysis chamber due to degassing (pyrolysis gas/water vapor) and/or removal of solid component parts is compensated by replenishing and post-compacting of pyrolysis goods.

The higher pressure in the pyrolysis chamber guarantees a better forced flow of the gaseous pyrolysis components through the pyrolysis goods and the pyrolysis coke leading to a better heating-up and additionally to a shorter degasification time, so that the high efficiency of the plant is guaranteed.

Compacting, force feed and post-compacting of the pyrolysis goods are intermittently carried out in an advantageous additional process.

Feeding the pyrolysis goods and withdrawing the solid residues may be effected simply in that the tubular or channel-like pyrolysis chamber has, if needs be, adjustable reduced cross sections at its entrance and exit sides so that a stopper will form also at the exit side. Due to the continuous addition and compacting of pyrolysis goods, this self-sealing stopper is continuously renewed.

Due to the use of such an elongated pyrolysis chamber according to the invention, into which the waste goods are entered maintaining a compacted condition, such chamber working continuously, there results a very good heat conductivity for and into said compacted waste goods on account of the given air-void-free pressure contact with the chamber walls. As to the length/diameter proportion, the use of pyrolysis chambers having a length-to-diameter ratio of over 10:1 has been found to be advantageous.

A batch-wise, i.e. intermittent, force-feed of the pyrolysis goods or the post-compacted solid residual matter has, in addition, the advantage that, in cooperation between the pressure contact of the pyrolysis goods and the chamber walls, incrustations and baked-on pyrolysis residues on the chamber walls are removed due to the constant friction force exerted upon the chamber walls by the advancing pyrolysis goods. In such embodiments, the pyrolysis chamber is self-cleaning. It contains furthermore no movable component parts which are subject to failures in a long-term operation and will present difficulties in particular as regards sealing and lubrication.

The solid pyrolysis residues are advantageously removed in hot condition (approximately 400° C.) into a melt cyclone (post-combustion chamber) and are burned there under oxygen addition or are melted up to slags.

Thus it is possible to utilize the total energy contents of the hot pyrolysis coke.

On using pure oxygen or at least oxygen-enriched air, the high nitrogen content of the air needs not to be heated up, so that the waste gas volume is considerably reduced and the waste gas purification is technically well controllable and can be effected more efficiently.

The high carbon content of the residue produced during low-temperature pyrolysis has excellent pollution-binding properties. This feature can still be increased by adding pollution-binding adjuvants to the pyrolysis goods prior to compacting.

A further special advantage is due to the fact that the exit of the gaseous pyrolysis products from the pyrolysis chamber occurs at the end of the haulage-way. In the case under consideration, the hot gaseous pyrolysis products flow, on the one hand, through the pyrolysis goods in their full length, on the other hand, the pyrolysis chamber will become pressureless only immediately before the removal which simplifies the sealing of the pyrolysis chamber on the exit side. In accordance with the appearing flow of the gaseous pyrolysis products and the pressure drop caused thereby along the pyrolysis chamber, the highest pressures prevail at the entrance side taking care thereby both for quick heating and quick degassing.

An optimum heat transfer due to pressure contact, an optimum heat conductivity due to reducing the air-void volume and additional volume heating by the gaseous pyrolysis products themselves are advantages of the pyrolysis method according to the invention as far as the heat-up of the pyrolysis goods as opposed to prior art is concerned. The pyrolysis itself constantly improves the heat conductivity of the pyrolysis goods, in particular in the contact zones with the walls, so that there the already higher pyrolyzed areas transfer the heat better, due to their higher heat conductivity, to the internal zones which are not yet that good pyrolyzed. An additional effect shows in that the carbon-rich residues in their compacted or post-compacted condition have a much better heat conductivity than the original pyrolysis goods. The compact condition of the pyrolysis goods and residues as well as the constant pressure contact of said pyrolysis goods with the chamber walls minimize not only the required dimensions of the pyrolysis chamber, they also considerably shorten the required pyrolysis time.

On preparation of industrial wrecks such as passenger cars, refrigerators, washing machines etc. easily to be handled scrap packages are produced by large-volume apportioning of the scrap goods, by dividing and/or crushing while maintaining its mixed and compound structure, spending a minimum of preparation expenditures. In particular by crushing the industrial wrecks it is possible to obtain scrap packages of approximately equal outside dimensions, a fact which facilitates their handling in the pyrolysis chamber. The apportioning of the scrap is thereby feasibly made so that adequate degassing volumes will be maintained. The large-volume apportionment facilitates the feeding into the pyrolysis chamber by means of intermittently operating charging and discharging devices for the scrap goods.

In particular, applying the method to motor vehicles to be scrapped it may become feasible to effect the large-volume apportioning of the scarp by structureless fracturing into relatively large wreck sections. Thus, the volume of the pyrolysis portions may be restricted. The fracturing may be carried out both with rippers and with other cut or separation methods. To crush again the so produced wreck sections to predetermined dimensions may be feasible for simplifying their handling.

The post-combustion of the pyrolysis gases in the process according to the invention may be effected in a separate part of the pyrolysis chamber, which has the advantage that part of the combustion heat can directly be utilized for maintaining the pyrolysis. It will frequently be feasible, however, to carry out the pollution-poor post-combustion in a separate post-combustion chamber. In this case, the combustion conditions can be controlled in a more defined way obtaining a high pollution-free condition of the waste gases.

The handling may be facilitated—which is an advantageous further development of the inventive method—by combining the mixed scarp in collective containers and pushing them through the pyrolysis chamber. Such a way of proceeding is especially feasible in cases where different industrial wrecks are used the outside dimensions of which differ very much.

The temperature in the pyrolysis chamber is feasibly controlled so that the melting point of the slag residues is not attained on complete degassing and at least partial gasification of the pyrolyzable components of the scrap. This way of proceeding has certain advantages: The pyrolysis residues do not adhere to the metallic components of the scrap and can easily be separated, and the not yet mineralized (molten on) pyrolysis components still contain absorption-capable carbon in porous form, i.e. with large active surfaces, for binding polluants.

Mixed scrap contains, as a rule, only limited portions of pyrolyzable material. E.g., the non-metallic portions of a vehicle of usual construction amount to less than 30%. Both for reasons of waste disposal and for energetic reasons it may therefore be feasible to add waste of higher calorific value to the said mixed scrap. This can be done in a simple manner by using the consumption wrecks themselves as "containers" by filling their residual cavities partly with such waste. Another possibility is to compact at first such additional waste together with the portioned wrecks into the said containers sending them then into the pyrolysis chamber. Another possibility of developing further the method according to the invention is, that a plurality of pyrolysis chambers are coordinated with one post-combustion. This possibility presents certain advantages, in particular if separate post-combustion chambers are provided and if the feeding of the pyrolysis chambers is done staggered in time, so that the sum of the generated gas volumes can be kept approximately constant.

In the preparation of both domestic and industrial waste and also of industrial wrecks or the like waste disposal goods, the produced pyrolysis products contain, as a rule, polluants which must not be emitted into the environment.

According to the invention, therefore, in a preferred embodiment the solid, liquid and/or gaseous process products containing polluants as produced during the pyrolysis are led through one or more molten baths which are kept upon different temperatures and/or have different compositions. By the fact that the polluant-loaded pyrolysis products are led through molten baths, the temperature values of which lie in a range of 1500° C. to 2000° C., it is possible to adjust both the decomposition temperatures of organic polluants and e.g. the condensation temperature on inorganic polluants in the single baths to an optimum and to keep them constant within narrow limits. Also one melt container may be sufficient depending on the case of application.

In the high-temperature molten baths, at first the organic polluants are completely decomposed. A particular advantage is the fact that the flow through at least one molten bath is connected with by far less velocity than the combustion of the polluants in a gas burner as per prior art. In the high-temperature liquid the contact times between polluant-containing gas or liquid and/or solid contaminations are so much furthered that longer discharge paths may be dispensed with, the inventive method can work with a device build-up which is considerably more simple and compact than comparable plants. The flow of the polluant-loaded gaseous pyrolysis products through a high-temperature molten bath requires a certain pressure drop, like in conventional filtering plants, which can be produced by pre-compressing the polluant-containing materials to be led through and adducing same to the high-temperature melting bath under high pressure, but also by keeping the molten bath under negative pressure.

Such molten baths may consist of one or different materials melting at the high temperatures in question. The material selection of the molten baths depends, in addition to the desired temperature range, on the polluant conversion strived at for the respective bath. Metallic baths are favorable for the conversion of certain polluant combinations. Molten glass baths can be adapted to a large temperature range, as regards their viscosity, so that a problem-free passage and subdivision of the polluant-containing material is possible. In addition, glass has also excellent binding properties for solid inorganic polluants. E.g., lead and arsenic are so-called network-formers in actual glass structures which are incorporated in respectively formulated glass sorts without problem and are resistant to leech-out, having a high acceptance capacity. A further advantage of the use of glasses as high-temperature molten baths must be considered that any non-sorted otherwise scarcely utilizable waste glass can be used.

If the method according to the invention is used for the after-purification of withdrawn products of waste pyrolysis, the waste glass portion of the domestic waste impossible to be avoided can directly be utilized. Glass melts the temperatures of which are higher than 1200° C. assure that all organic polluants susceptible to be contained in the waste gases are totally decomposed, in particular also dioxins and furans.

In addition to the above metal and glass molten baths, baths consisting of molten salts have the advantage that polluant components such as chlorine, fluorine and sulfur or the like are neutralized there and are converted into compounds which are neutral vis-á-vis the environment. Depending on the kind of polluant quantity and composition of the pyrolysis products, it is feasible to switch a plurality of molten baths in a row, the baths possibly be staggered as to temperature so that the temperature of the bath next upstream is always higher than the temperature of the bath next following downstream. This causes in an advantageous manner that the heat loss of the pyrolysis products heats always the next following bath downstream so that a separate heating can be usually dispensed with. High-temperature baths can be additionally be heated in such a cascade arrangement of the baths by burning the produced pyrolysis coke under oxygen addition. In the baths of this cascade which have a lower temperature, polluants which remain volatile at temperatures, at which organic substances are decomposed, may be condensed and chemically bound so that they can be removed in an insoluble form.

Scientific knowledge as of today concerning the decomposition of organic polluants and the binding of inorganic polluants in form of a mineralization in combination with an additional polluant condensation shows that the freedom from polluants of the thus treated gases is guaranteed by applying the method according to the invention. A monitoring of the gases freed from polluants with measuring can either completely be dispensed with or can be reduced to a minimum such as monitoring a representative element or compound.

The gas-tight arrangement of a high-temperature bath or a molten-bath cascade immediately at the discharge opening of the pyrolysis reactor makes failure-prone sluices superfluous.

Differences in the specific weight between glasses and metals and salt melts allow the fractionate withdrawal of recycling materials in a most simple and hygienically unobjectionable manner from molten baths of the respective temperatures.

Unlike the conventional pyrolysis technique which tries to improve and to accelerate the heat soaking of the waste by loosening the waste which results in expensive preparation plants and voluminous pyrolysis furnaces, the reactive compactation according to the invention is based upon the observation that a compactation of loose mixed waste to densities of partly over 2 $g/cm^3$ improves the heat conductivity in the material to be pyrolyzed so that the pyrolysis in this compacted conditions presents no problems. Therefore, there is spoken of a low-temperature pyrolysis. The substances contained in the waste which are to be found in the molten baths, improve additionally the heat conductivity during pyrolysis; inert substances, such as glass, do not disturb the process.

This reactive compacting complies therefore with all presuppositions in order to meet the requirements which are to be demanded of a modern, economical waste disposal, in as much as there are no principal restrictions for the function of small plants.

Figure 2:
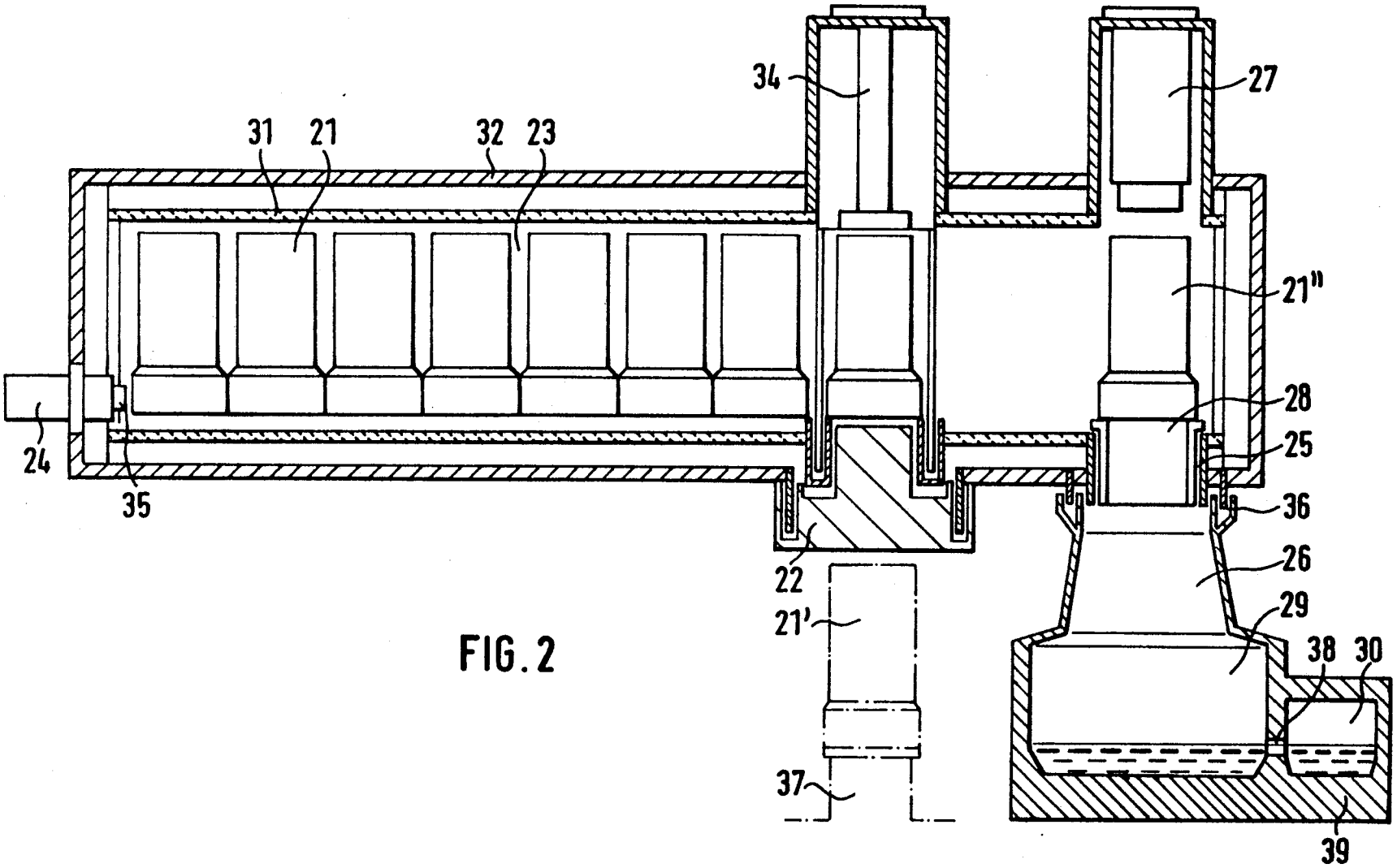
Figure 3:
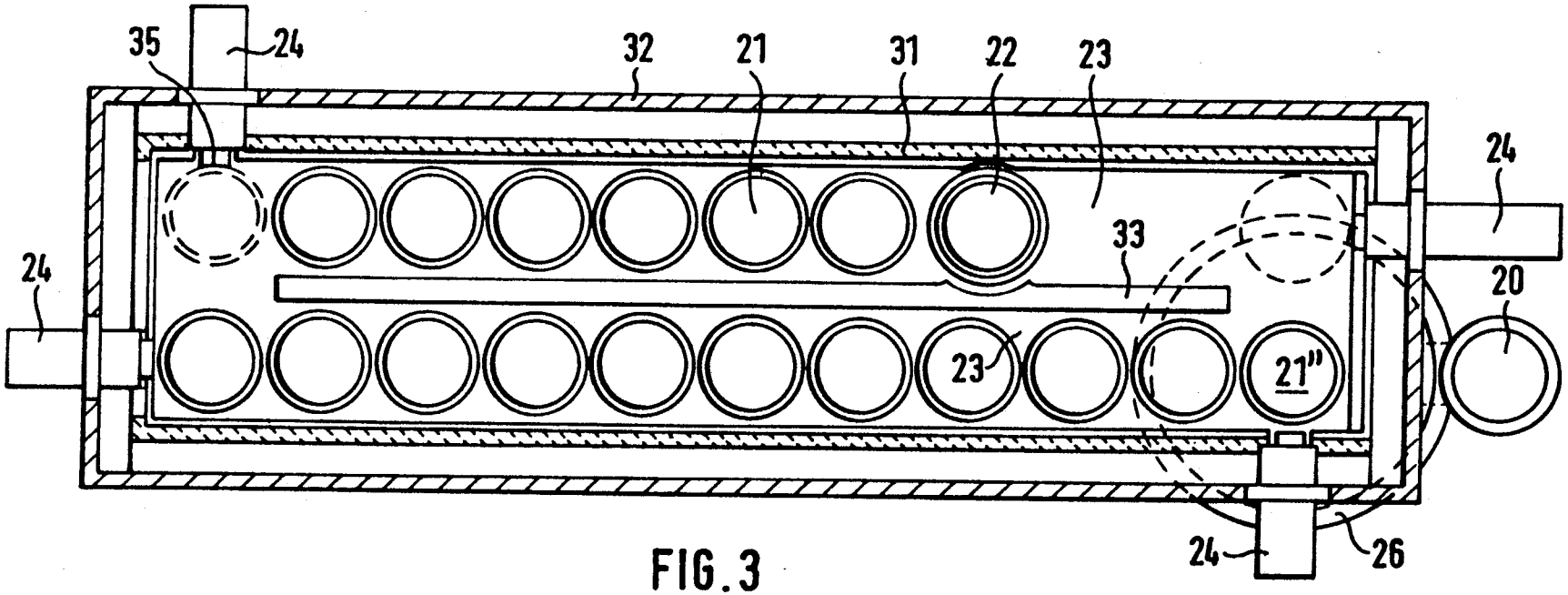
Figure 4:
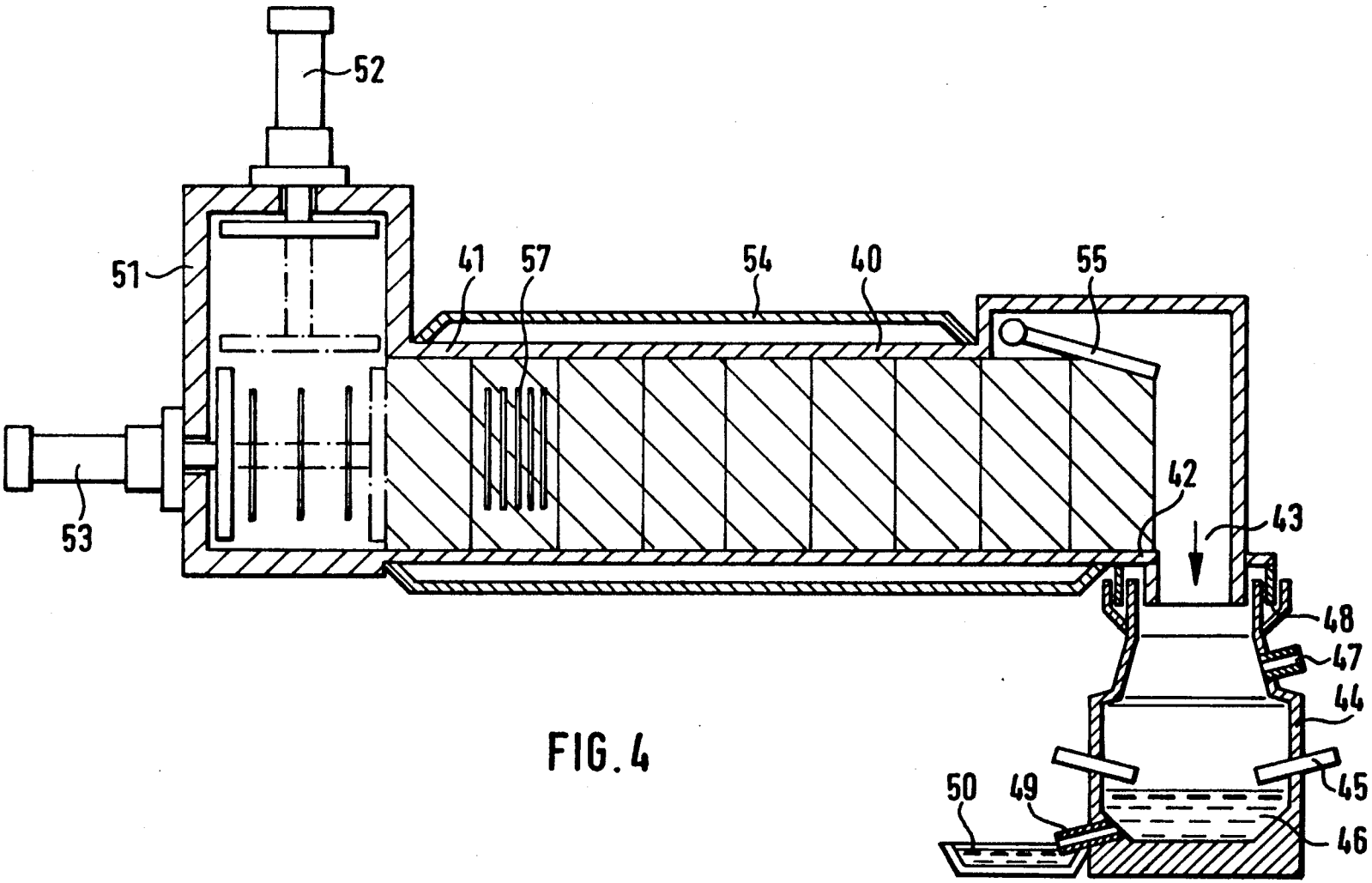
Figure 5:
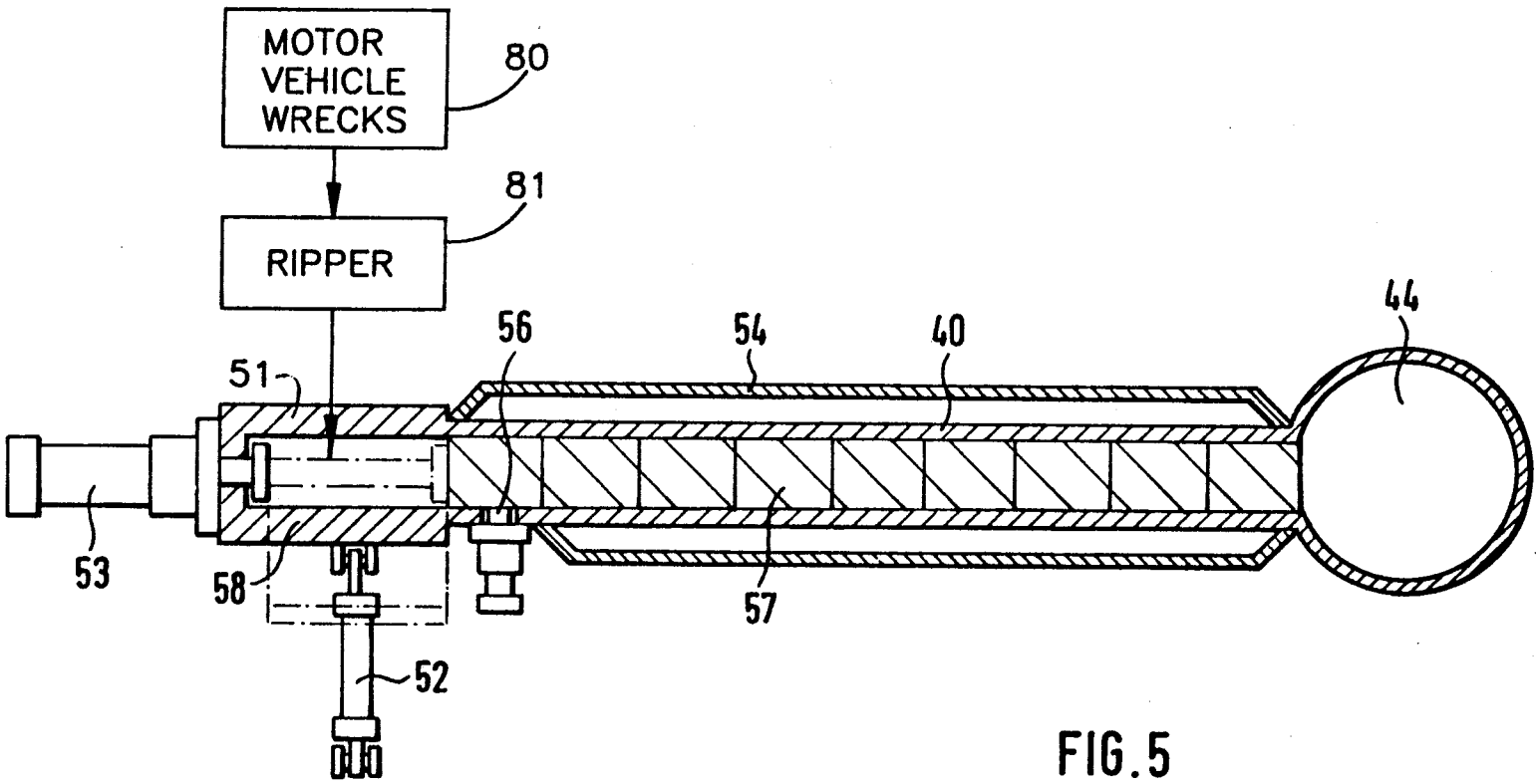

Three constructions of devices for the reactive compacting, low-temperature pyrolysis, transport and intermediate storage facilities given by pre-compacting, and the high-temperature treatment will now be further explained taking regard to the accompanying drawings, such drawings representing schematized embodiments in a strongly simplified form only. There show:

FIG. 1 a schematic cross sectional view of a first embodiment of the device according to the invention having only one pyrolysis tube with a melt-down gasifier coordinated therewith;

FIG. 2 the diagrammatic sketch of another advantageous pyrolysis chamber built-up as continuous-heating furnace for accepting a plurality of pyrolysis containers in connection with another high-temperature furnace;

FIG. 3 a top view on the set-up according to FIG. 2;

FIG. 4 still another especially advantageous embodiment of a continuous-heating pyrolysis chamber with a melt-down furnace switched-in downstream; and FIG. 5 a top view on the embodiment according to FIG. 4.

Taking reference to FIG. 1, a heatable tube, named hereinafter pyrolysis tube 1, is vertically disposed above a molten bath tank 10 and connected gas-tight with same. This tube acts as a pyrolysis chamber. The material transport between said tube 1 and the molten bath tank 10 is carried out by gravity. Expensive, temperature-loaded and failure-prone transport devices are dispensed with. A pre-compacting device for the pyrolysis goods to be filled into the upper opening of the vertically disposed pyrolysis tube 1 should appropriately be provided at the charging end, is however not shown in the drawing for reasons of simplified representation. A pre-compacting device has the advantage of being able to charge also bulky pyrolysis goods into the pyrolysis tube 1 even without previous preparation. The charging of pyrolysis goods is furthered by a funnel-shaped enlargement of the pyrolysis tube 1 in the area of the upper opening. A cramming device 2 moves periodically into the said funnel-shaped enlargement and pushes the precompacted pyrolysis goods batch-wise into and through the pyrolysis tube 1.

The said cramming device 2 is a pneumatically, hydraulically or gravity-driven hammer, such as e.g. commercially available in a comparative modification and operational design for driving-in sheet piles or foundation piles. The hammer is guided by means of guide rollers or other suitable guide devices in alignment with the pyrolysis tube so that it is movable upward and downward in vertical direction. Its ramming tool 2' has a shaped head piece by means of which the pyrolysis goods is periodically crammed or beaten into the pyrolysis tube 1. The exclusively force-locking connection between the pyrolysis goods and the hammer has the essential advantage that no unduly high forces can appear in the charge area which are otherwise unavoidable in the case of a force-guided cramming device. Especially solid components in the pyrolysis goods, such as metal parts or the like, could otherwise cause an overload on the cramming device. This is however excluded in the device described above. The pyrolysis tube 1 accepting unsorted pyrolysis goods which is moved batch-wise over the tube's total length through same, has a length/diameter ratio of above 1:10. In tubes of that geometry, the advance velocity of the pyrolysis goods may be especially easily adapted to the compacting conditions of the pyrolysis goods in the pyrolysis tube 1 and thereby to the pressure against the walls of the pyrolysis tube. The pyrolysis goods leaves the mouth of the pyrolysis tube 1 in a totally pyrolyzed state and with an optimum quantity throughput.

The heating of the pyrolysis tube 1 is feasibly carried out by gas burners 9 acting from outside, which are disposed distributed within the heating jacket 16 alongside the tube. This outside heating by means of gas burners has the great advantage, that the produced pyrolysis gases can directly be utilized for this purpose. The insertion of a control device 8 between the gas exits 6 from the pyrolysis tube 1 and the burner 9 allows the control of the process in a simple manner. The pyrolysis tube is heated up to temperatures between 250° and 500° C. the charging area of the pyrolysis tube being exempt from heating. In this area, a solid stopper will form on cramming which safely interrupts the gas exit from the mouth of the pyrolysis tube into the open air and which renews itself automatically and continuously. This is a substantial advantage because gas-tight charging sluices which have proved to be failure-prone in pyrolysis devices, are rendered totally superfluous. The waste gases of the gas burners 9 are collected in the jacket 16 and are led to a waste gas chimney, if needs be through a filter plant. The exit openings for pyrolysis gases from the pyrolysis tube 1 are located in the vicinity of the mouth area of the pyrolysis tube. They are collected in a ring conduit and are fed to the control device 8 for distribution. Not shown in FIG. 1 is the advantageous possibility of preheating the combustion air for the operation of the gas burners, e.g. by leading alongside the outer faces of the heating jacket 16 and/or enriching the combustion air with oxygen. The increase of the flame temperature of the burners in connection with said measures guarantees the decomposition of organic polluants in the pyrolysis gas and thereby the absence of polluants in the waste gases.

The exit area of the pyrolysis tube 1 is equipped with a tapering constriction part 14 the cross section of which is controllable, if needs be. This constructive measure makes sure that the residual solid matters of the pyrolysis are post-compacted, sealing at the same time the discharge area of the pyrolysis tube against gas escape. The backwash connected with this post-compacting in the pyrolysis goods furthers its densification during cramming and improves the total pyrolysis process.

The molten bath tank 10 is alignedly disposed underneath the pyrolysis tube 1. It is provided with a refractory internal lining 11 which will withstand a temperature of above 1300° C.

The molten bath is heated up by gas burners 9' which are directed to the surface level of the molten bath. Their effectiveness can be controlled by the addition of oxygen by means of a controller not shown in FIG. 1. Carbon-containing pyrolysis residues can be totally after-burned by means of the oxygen addition whereby, on the one hand, the quantity of solid residues is reduced and, on the other hand, also additional heat energy is supplied to the molten bath. Oxygen addition is also possible through excess oxygen in the fuel gas of the burners 9'. The high molten bath temperature causes a mineralization of the pyrolysis residues. The mineralized slags guarantee a leechout-proof binding of all polluants making thus the residues to be ecological or inert materials for construction engineering or the like.

Contents of old glass in the pyrolysis goods further these properties. The sorting-out of old glass prior to pyrolysis is dispensed with. The physical properties of the molten bath 12 in the molten bath tank 10 can be improved by additional aggregates which are added to the pyrolysis goods prior to its feeding into the pyrolysis tube 1. Lime or dolomite aggregates effect both the binding of polluants already during the pyrolysis and a liquefaction of the slags in the molten bath.

As shown in FIG. 1, a dip pipe 13 is disposed in the exit area of the pyrolysis tube 1, which dips into the molten bath 12 preventing the transfer of dusts of the pyrolysis residues into the gas volume of the molten bath tank 10 and assuring the immediate introduction of the residues into the melt. The waste gases of the molten bath tank 10 are refluxed into the pyrolysis gases through a waste gas line 18. Their possible polluant contents is rendered innocuous by afterburning in the gas burner 9 or 9'. The reduction of the calorific value of the pyrolysis gases possibly connected with the gas reflux is mostly compensated by the higher temperature of the waste gases of the molten bath tank 10.

The high temperature of the molten bath for the pyrolysis residues does not only allow an effective polluant binding by mineralization, it offers also the possibility of separating valuable substances contained in the pyrolysis goods. If one selects e.g. the temperature of the molten bath 12 higher than the melting temperature of steel, it is possible to fractionately withdraw mineralized light substances which float upon the molten steel by several overflows in different heights of the molten bath tank. The separation of recycling metals reduces not only the still required dump space but the effectivity of the method is further enhanced.

The mode of operation of the device shown in FIG. 1 is as follows: The periodical cramming movements of the device 2, 2' in the direction of the arrow highly compacts the pyrolysis goods in the not heated area of the charging opening of the pyrolysis tube 1 and forms the wanted tight stopper. The continuous pushing of the pyrolysis goods constantly re-builds said stopper and effects a reliable sealing free of maintenance. With the entrance into the following heating section begins the pyrolysis of the compacted material starting from the tube wall. The continuing supply of pyrolysis goods balances the mass loss due to the pyrolysis so that the pressure against the tube wall necessary for a good heat transfer is maintained up to the end. With the growing throughput grows also the thickness of the pyrolyzed ring zone from the tube wall toward the interior, so that shortly before the exit area, i.e. approximately in the height of the exit bores 6 for the pyrolysis gas, the pyrolysis goods is pyrolyzed fully through. The remaining solid residues of pyrolysis fall finally through the dip pipe 13 into the molten bath 12 where they are molten-up and mineralized.

The compact construction of the pyrolysis device due to the principle of reactive compacting, allows to avoid the loss of uncontrolled waste heat by effective heat insulation and to suppress acoustic emissions by shielding.

Another embodiment of the device for implementing the present method is schematically represented in the FIGS. 2 and 3. In this case, the pyrolysis chamber does not consist of a vertically disposed tube which accepts directly the waste goods to be pyrolyzed, but of a continuous-heating furnace 23 which accepts a plurality of containers 21 in the form of cartridges. The cylindrical cartridges 21 replace in this respect as tube sections the single tube of the embodiment above described. Such containers or cartridges 21 are compactedly filled with the waste goods, such as domestic waste, in a neighboring or also remote filling station prior to being fed to the continuous-heating furnace 23, and the waste present in a compressed form inside the cartridges 21 is entered in this form into a sluice 22 forming the charging opening for the pyrolysis chamber, the continuous-heating furnace 23. On entering and later withdrawing the various cartridges, the escape of pyrolysis gas is prevented due to the sluice. The various cartridges are located alignedly on a suitable transport organ 37 one after the other below the sluice 22 in the correct position and are fed from there by a lifting movement into the continuous-heating furnace.

The filling of the cartridges 21 does not need to be locally connected with the pyrolysis furnace plant, but may be done at any place, so e.g. also in a Community Waste Collection Point to which any waste goods are supplied in loose or slightly pre-compacted form. The waste goods is then compacted in the ready empty cartridges by means of a simple cramming device. The cartridges made available in standardized sizes are then transported from the collection or storage points with the space-savingly compacted waste goods to the preparation plant. The cramming-compacting of the waste goods into the tubular cartridges is done while maintaining its mixed and composite structure, i.e. without previously sorting-out or separating dangerous waste components. The filled tubular cartridges can be freely intermediately stored and can be reused after completed pyrolysis and discharge in analogy with a returnable container.

The pyrolysis chamber in the embodiment as per FIGS. 2 and 3 consists of a continuous-heating furnace 23 of rectangular cross section which accepts, separated by a guide wall 33, two rows of cartridges which are circulated through the furnace by means of suitable pushing devices 24. In this respect, altogether four pushing devices 24 are provided practically at the wall sections of the continuous-heating furnace diametrically opposing one another in order to be able to preset the four advance direction of the cartridges 21. The feed is intermittently done by one cartridge each. The continuous-heating furnace 23 consists of a furnace housing 32 lined with refractory material 31. The inner space of the continuous-heating furnace 21, i.e. of the pyrolysis chamber, is held upon a temperature of 400° to 600° C., and the various cartridges 21 are circulated as shown. They are intermittently pushed through the furnace so that each cartridge dwells in the pyrolysis chamber for about 3 hours which guarantees a total degassing of the domestic wastes or similar waste goods within the cartridges. The throughput of the various cartridges 21 through the continuous-heating furnace 23 begins after the entering of the filled cartridge 21' through the sluice 22 progressively along the one half of the continuous-heating furnace between the guide wall 33 and the furnace housing along the length of the pyrolysis chamber up to its opposing front face by means of a pushing device 24, then along the front face by means of a second pushing device, and finally in the opposite direction again between the longitudinal wall of the furnace and the guide wall 33 by means of the third pushing device. From the fact that the said pushing devices activate intermittently a pusher, piston or ram 35 results the so-called step movement. The fourth pushing device pushes each one cartridge 21" which has completely passed through the furnace in an aligning position above the high-temperature furnace 26 disposed at this end of the pyrolysis chamber below the continuous-heating furnace 23. Likewise aligned above the cartridge 21" to be emptied and therewith aligned with the high-temperature furnace 26 there is an ejector device 27. Said ejector device empties the totally pyrolyzed cartridge 21" so that the pyrolysis products in the form of densified carbon and inert materials such as metal compounds, glass and other minerals, fall through the opening 28 into the melt 29 of the high-temperature furnace 26. The high-temperature furnace 26 is a molten bath tank approximately in the mode of a melting-down gasifier which is operated like the molten bath tank 10 of the embodiment according to FIG. 1. The ejector device 27 and the molten bath tank 29 are gas-tight connected with the interior of the continuous-heating furnace 23. The molten bath tank is connected with the furnace casing 32 by means of a sealing 36. Likewise gas-tight connected with the furnace casing is also the charger device 34. The high-temperature furnace 26 is schematically represented in the lateral section in accordance with FIG. 2 only outlined by a furnace wall surrounding 39. Integrating constituent part of the high-temperature furnace 26 is then a collecting container 30 which is adjacent to the melt 29 communicating therewith by means of an overflow 29, so that, if needs be, the fractionate tapping of the melt not necessarily must be done immediately above and from the high-temperature furnace.

The volatile gases produced within the cartridges 21 passing step-wise through the continuous-heating furnace 23 are fed together with the water vapor to the molten bath tank 29 through one or more gas exits 25, serving there, together with the likewise produced carbon and the added oxygen, for heating-up the melt 29 and keeping the temperature in the high-temperature furnace and in the storage tank 30.

Due to the use of oxygen-propane burners or oxygen-process gas burners for heating the continuous-heating furnace 23, temperatures in the range of 2000° C. may very advantageously be obtained in the high-temperature region of the burner. Thereby it is possible, on the one hand, to directly thermally decompose higher-molecular organic compounds and polluants produced in the pyrolysis gas already in the pyrolysis chamber, and, on the other hand, to free the process gases used for the production of energy instead of propane, of polluant traces by a splitting process rendering them thus innocuous. This mode of procedure results therefore not only in a highly reduced portion of organic polluants but there remain also altogether strongly reduced process gas quantities to be cleaned prior to an external utilization for producing energy.

After emptying the cartridge 21" in the aligned position with respect to the high-temperature furnace 26, said cartridge is fed in circuit up to the aligned position above the sluice 22 in order to be removed there by means of the charging device 34 and to be set upon the conveyer device 37. The empty cartridges 21' are either filled with waste goods anew immediately after or are transported to a remote cramming plant by means of trucks. It is also possible to provide separate sluices for charging and removing the cartridges into or from the continuous-heating furnace.

The temperature in the high-temperature furnace 26 is kept by means of the combustion of the gases produced during pyrolysis on the one hand, and by the combustion of the carbon densified by the pressure pyrolysis on the other hand, while adding oxygen, so that the upper furnace area shows approximately 1000° C., whereas in the lower furnace area within the melt approximately 1600° C. should prevail. The high-temperature onset under the addition of oxygen takes place so that the carbon dioxide produced due to the exothermic reaction of the carbon with oxygen in accordance with the Boudouard reaction is transformed into carbon monoxide, and thereby temperatures of over 1500° C. act upon the totality of the reaction products. The melt is composed of liquid slags, glass, metal and other inert substances of different concentrations in accordance with the waste goods charged. This melt then flows through the overflow 38 into the storage tank 30 and is intermittently or continuously withdrawn from there.

Referring now to the FIGS. 4 and 5, there is shown a side view and a top view of another, very preferred embodiment of a device for the implementation of the pyrolysis method according to the invention. In this example, the pyrolysis chamber consists of an elongated, channel-like furnace shaft 40 which is substantially horizontally directed, having a charge end 41 and a discharge end 42. The pyrolysis waste goods is entered via a charging device 51, having approximately a box-like shape in the embodiment shown, either in the form of non-compacted and non-assorted waste goods or also pre-compacted and apportioned, e.g. contained in thermally decomposable containers. The charging device 51 is provided therefor with a compacting device 52 and a pusher 53. This double pusher device, the rams of which work intermittently i.e alternately and perpendicular to one another as can be taken particularly from the representation in FIG. 4, is intermittently charged with waste goods the mixed and composite structure of which may be as it is, from above, i.e. again perpendicularly with respect to the two ram movements. The waste goods filled in non-compacted or pre-compacted conditions will be post-compacted by means of the compacting device 52, whereupon it is likewise intermittently crammed into the furnace shaft 40 and thereby into the pyrolysis chamber proper by means of the ram 53. It thereby forms a solid and gas-tight stopper consisting of the waste goods continuously filled-in at the charging end 41, at the same time the compacted waste goods 57 being advanced along the pyrolysis chamber due to this process, maintaining its compacted condition, due to the intermittently operating cramming, over the whole cross section of the furnace shaft, maintaining further the pressure contact with the chamber walls over the total length of said pyrolysis chamber. For carrying out the low-temperature pressure pyrolysis, a heating jacket 54 is disposed around the furnace shaft 40, so that it is possible to heat up the pyrolysis chamber in analogy with the embodiment according to the already described FIG. 1.

The state of compactness of the pyrolysis goods in the interior of the pyrolysis chamber may be controlled by means of a cross section metering device 56 at the charging end, but also by means of a cross section metering device 55 at the discharging end, the cross section metering device 55 at the discharging end being made e.g. in the form of an impact flap so that it may serve simultaneously as discharge device for the pyrolysis goods at the discharging end 42 of the pyrolysis chamber. The embodiment according to the FIGS. 4 and 5 shows that there apportioned waste goods quantities are continuously pushed through the furnace shaft 40. As to the rest, the pyrolysis sequence in the represented channel-like pyrolysis chamber corresponds substantially to the pyrolysis sequence in the tube-shaped pyrolysis chamber in accordance with the embodiment according to FIG. 1.

The discharging device 43 at the end of the furnace shaft 40 for the pyrolysis product degassed there is located in the bottom of the furnace shaft 40 of rectangular cross section, as shown in FIG. 4, and is directly connected with the molten bath tank 44 or a melt-down gasifier via a gas-tight sealing 48. The molten bath tank 44 is again comparable with the molten bath tank 10 of the embodiment in FIG. 1 or the high-temperature furnace 26 as shown in the FIGS. 2 and 3, as regards its build-up and its functions.

The molten bath tank 44 provided with a refractory lining accepts the bath melt 46 in its lower area to the surface of which a plurality of oxygen lances 45 is directed, and at least one gas exhaust 47 is located in the upper reset area of the molten bath tank. A molten bath overflow 49 is designed in the embodiment for the tapping of the melt and the melt product can be withdrawn there into a melting crucible 50.

FIG. 5 is the longitudinal section of FIG. 4 in top view, additionally a stop flap 58 being provided for the charging device 51 for the domestic waste or similar waste goods. The stop flap 58 is opened so that large industrial goods such as motor vehicle wrecks 80 may be introduced into the charging device 51 after being divided by a ripper 81 while maintaining their mixed and composite structure.

I claim:

1. Method for the intermediate storage, transport and/or energetic and material utilization of industrial, dangerous and domestic waste and of industrial wrecks of differing composition and the like waste goods of all kinds, said method comprising the steps of mechanically compacting waste goods down to a fraction of their original volume while maintaining their mixed and composite structure, subjecting the waste goods in their compacted form to pyrolysis thereby forming pyrolysis products while maintaining the totality of the pyrolysis products under elevated pressure and immediately and without intermediate cooling subjecting the pyrolysis products to a high-temperature onset, thereby gassifying any condensed carbon portions of said pyrolysis products to form a gaseous portion, adding oxygen to the high-temperature onset so that carbon dioxide is produced due to the exothermic reaction of the carbon with oxygen in accordance with the Boudouard reaction which is transformed into carbon monoxide, and wherein temperatures of over 1500° C. act upon the totality of the reaction products, and melting any metallic mineral component parts out of the remaining pyrolysis products.

2. Method according to claim 1 further comprising the steps of geometrically compacting the waste goods to make packets of approximately equal geometry adapted to a container shape and cramming the waste goods into such containers by means of a cramming device for pyrolysis in such compacted condition.

3. Pyrolysis method for degassing organic substances in pyrolysis goods such as domestic wastes, industrial wastes or the like in a heatable pyrolysis chamber comprising the steps of:

charging the pyrolysis goods into said pyrolysis chamber, simultaneously mechanically compacting and moving the pyrolysis goods through said pyrolysis chamber, maintaining the compacted condition across the cross section of the pyrolysis chamber resulting in pressurized contact by the pyrolysis goods with the chamber walls, transferring heat to the pyrolysis goods through the chamber walls in pressure contact with the pyrolysis goods, removing any gaseous pyrolysis products produced under elevated pressure;

closing said pyrolysis chamber in a gas-tight manner in its charging area by means of the compacted pyrolysis goods; and post-compacting any solid pyrolysis residues to create an increase resistance to flow in the discharge area of the gaseous pyrolysis products.

4. Method according to claim 3 further comprising the step of conveying the pyrolysis goods through a tubular or channel-like pyrolysis chamber.

5. Method according to claim 4 wherein the charging of the pyrolysis goods, the compacting of the pyrolysis goods and the conveying of the pyrolysis goods through the pyrolysis chamber is made intermittently.

6. Method for the ecological preparation and consumption of industrial goods such as wrecks of motor vehicles or the like in accordance with either claim 1 or 4 further comprising the steps of:

a) apportioning the wreck goods into large-volumes of scrap by dividing said wreck goods while maintaining their mixed and composite structure;

b) intermittently charging the scrap apportioned in large volumes into a pyrolysis chamber; and c) thermally treating the contents of the pyrolysis chamber up to the total degassing and at least partial gasification of the carbon-containing organic components.

7. Method according to claim 6 further comprising the step of directing the solid, liquid and/or gaseous process products and pollutants produced during pyrolysis through a plurality of molten baths kept on different temperatures and/or being of different compositions.

8. Method according to claim 2 wherein the heat treatment of the waste goods remaining in the container in their compacted condition is carried out in a continuous-heating furnace in which a plurality of containers are pushed in circulation.

9. Device for degassing pyrolysis goods containing waste organic substances comprising a pyrolysis chamber including a heatable tube having a charging end and a discharge opening, a pre-compacting device at the charging end, a cramming device feeding the pyrolysis goods into the pyrolysis chamber while post-compacting same, at least one gas discharge device located in the vicinity of the discharge opening of the pyrolysis chamber, and a molten bath tank being located immediately downstream of the discharge end of the pyrolysis chamber and connected gas-tight with same.

10. Apparatus according to claim 9 wherein the pyrolysis tube is disposed vertically on top of the molten bath tank.

11. Device according to claim 9 wherein the cramming device includes a cramming ram dipping into the upper charging opening of the pyrolysis tube.

12. Device according to claim 9 wherein said pyrolysis chamber comprises a continuous-heating furnace which accepts a plurality of containers with compacted waste goods.

13. Device according to claim 12 wherein said continuous-heating furnace comprises means for intermittently moving the containers in a circuit through the continuous-heating furnace.

14. Device according to claim 12 wherein said continuous-heating furnace has an elongated and rectangular floor plan.

15. Device according to claim 9 wherein the pyrolysis chamber has the shape of a channel-like, preponderantly horizontally directed furnace shaft which is surrounded by a heating jacket for at least a substantial part of its peripheral surface.

16. Device in accordance with claim 15 wherein the pre-compacting device at the charging end of the furnace shaft comprises a alternately operable double push ram device consisting of a compacting ram and a push ram which work perpendicularly with respect to each other.

17. Device according to claim 15 wherein the molten bath tank following the discharge end of the elongated pyrolysis chamber is connected therewith by means of a gas-tight seal, said molten bath tank being disposed below the furnace shaft.

18. Device according to any of the claims 15 through 17, further comprising cross section controllers which control the pyrolysis chamber cross section at the charging and/or discharging ends.

19. Device according to any of the claims 15 through 17 wherein the cross section of the pyrolysis chamber has a rectangular form.

* * * * *

UNITED STATES PATENT AND TRADEMARK OFFICE

CERTIFICATE OF CORRECTION

PATENT NO. : 5,311,830

DATED : May 17, 1994

INVENTOR(S) : Gunter H. Kiss

It is certified that error appears in the above-indentified patent and that said Letters Patent is hereby corrected as shown below:

On the title page, after "FOREIGN PATENT DOCUMENTS", insert —OTHER PUBLICATIONS Menges, et. al., "Recycling des Kunststoffanteils von Pkws: ja, aber Wie?" Plastics, 1988, pp573-583—;

Signed and Sealed this

Fourth Day of October, 1994

Bruce Lehman

*Attest:*

BRUCE LEHMAN

*Attesting Officer*

*Commissioner of Patents and Trademarks*